US006234483B1

(12) United States Patent
Bucan

(10) Patent No.: US 6,234,483 B1
(45) Date of Patent: May 22, 2001

(54) METHOD OF PLAYING A MATCHING CARD GAME

(76) Inventor: Blair Bucan, 415 A St., Apt. 201, Daly City, CA (US) 94014

( * ) Notice: Subject to any disclaimer, the term of this patent is extended or adjusted under 35 U.S.C. 154(b) by 0 days.

(21) Appl. No.: 09/298,583

(22) Filed: Apr. 23, 1999

Related U.S. Application Data

(60) Provisional application No. 60/083,181, filed on Apr. 27, 1998.

(51) Int. Cl.[7] ..... A63F 1/00; A63F 3/06
(52) U.S. Cl. ..... 273/292; 273/269
(58) Field of Search ..... 273/292, 309, 273/274, 269; 463/12, 13

(56) References Cited

U.S. PATENT DOCUMENTS

| | | | | |
|---|---|---|---|---|
| 5,275,415 | | 1/1994 | Wisted . | |
| 5,275,416 | | 1/1994 | Schorr et al. . | |
| 5,377,973 | * | 1/1995 | Jones et al. | 273/292 |
| 5,607,162 | * | 3/1997 | Boylan et al. | 273/292 |
| 5,816,577 | | 10/1998 | Preston et al. . | |
| 5,921,550 | * | 7/1999 | Awada | 273/292 |
| 6,004,205 | * | 12/1999 | Lauretta et al. | 463/11 |

OTHER PUBLICATIONS

Unknown, "Bango," The Little Giant Encyclopedia of Gambling Games, Sterling Publishing Company, Inc. (New York, NY), p. 85, (Apr. 23, 1996).
Unknown, "How to Play Flash Bingo," Unknown, Unknown (Unknown).

* cited by examiner

*Primary Examiner*—Benjamin H. Layno
(74) *Attorney, Agent, or Firm*—Richard A. Ryan

(57) ABSTRACT

A method of playing a matching card game based on chance that is similar to bingo where every player has an equal chance of winning the game. The game utilizes two identical decks of cards, a first deck of cards and a second deck of cards. After posting their ante to a pot, from which the house takes its cut, each player is given a predetermined number of cards from the first deck of cards. A chip is placed near each of the predetermined number of cards. A dealer reveals one match card at a time from the second set of cards. If the match card matches one of a player's predetermined number of cards, the player places the chip nearest the matching card on top of the matching card. The first player to match all of his or her predetermined number of cards is the winner and receives the balance of the pot.

29 Claims, 1 Drawing Sheet

METHOD OF PLAYING A MATCHING CARD GAME

CROSS-REFERENCE TO RELATED APPLICATIONS

This application claims the benefit of U.S. Provisional Application No. 60/083,181, filed Apr. 27, 1998.

BACKGROUND OF THE INVENTION

A. Field of the Invention

The field of the present invention relates generally to card games useful for playing in casinos, cardrooms and other card game locations. More specifically, this invention relates to chance card games that are bingo-like in nature and which require the participant to match cards with cards or numbers selected by the dealer.

B. Background

Many different types of card games are played throughout the world. Some of these games are specifically designed to be played in a casino or cardroom location whereby the participant attempts to win money, most often designated by playing chips, and the casino or cardroom makes money off each game or hand that is played. The most common of these types of games are Poker and Blackjack, which are both played with one or more decks of standard playing cards. For many people, however, these and other casino and cardroom card games can be very intimidating due to the complexities of the rules or the need to have a certain level of skill in order to have a realistic chance of winning. As a result, many people do not participate in these types of card games at all.

In contrast to the above-mentioned card games, many people participate in lottery draws, bingo games and the like where the chances of winning are not dependent upon skill and knowledge of the game. Many people prefer these types of games because they provide every participant with an equal chance of winning, notwithstanding the differences between the participants with regard to skill and knowledge. In particular, bingo games have become very popular as a form of entertainment and a way for persons without much background or experience in card games to play games of chance.

Generally, games involving primarily chance, such as bingo games, are not played at casinos and cardrooms. In part, this is due to the set-up of the bingo games, which generally require each player to have a bingo card, a caller to call out the numbers and a machine or other device to generate the numbers which are matched on the bingo cards. However, it would benefit casinos and cardrooms to offer a bingo-type card game to attract persons not interested in or capable of playing the more skill and knowledge orientated card games, including those persons who are the partners of persons playing the more difficult games. As a result, the number of participants and, therefore, the income for the casino or cardroom could increase.

One such game, patented as U.S. Pat. No. 5,816,577 to Preston, is referred to as Bingo Poker or the like. As played, this game utilizes two decks of standard playing cards (52 cards comprising four suits with thirteen cards in each suit) and is generally played with ten players. Each player antes four chips into the center of the table and the dealer deals three cards to each player from a mixed deck of cards. Each hand is ranked by standard poker rules and the highest ranked hand is designated as such. From a second standard deck of cards, which by its nature matches the first deck of cards, the dealer begins turning over cards one card at a time. If the number or value (i.e., face cards) of one of the dealer's cards matches the number or value of one of the player's cards, the dealer places one of the chips from the ante pot on top of that card. The dealer then continues turning over cards from the dealer's deck until one of the players has a chip on each of his or her three cards or until the dealer turns over nine cards. If after nine cards have been played by the dealer none of the player's have a chip on each of their cards, the player with the designated highest poker hand wins the chips remaining in the ante.

Several limitations exist with regard to the game as described and played pursuant to the Preston patent. One major limitation is on the limited amount of involvement by the player. In that game, the only activity for the player is to turn over his or her cards. All the rest is performed by the dealer, including placing the chip on the cards. Another limitation is that by utilizing a standard deck of cards (52 cards), there will generally be a substantial number of cards not played and for which there will be no matches, which creates the need to rank the cards by poker rules to speed the game up and make it interesting. There exists a need for a card game based on the concept of bingo-type matching that utilizes player participation, limited excess cards and which is compatible with standard poker tables.

SUMMARY OF THE INVENTION

The method of playing a matching card game of the present invention solves the problems identified above. The present invention discloses a card game that is a bingo-type matching card game that, in its preferred embodiment, requires player participation, has limited excess or unmatched cards and can be played on standard nine-player card tables. In the preferred embodiment, two partial standard playing card decks are utilized. The present invention overcomes the problems found in prior art card games, particularly those requiring knowledge and skill with regard to the relative complex rules and ranking systems of most casino and cardroom games. The present invention can be a good compliment to the typical casino and cardroom games for persons who are not interested in or capable of playing those games requiring higher knowledge and skill levels.

The method of playing a matching card game of the present invention utilizes two sets of cards, a first set and a second set, wherein the cards of the first set match the values of the cards of the second set. Although any number of cards can be used in each set, the preferred embodiment comprises 27 cards in each of the first and second set of cards. The first and second sets can be made up of standard playing cards wherein two complete suits, having 13 cards in each suit, and one joker are utilized to make up the 27 cards in each set. For instance the first set can comprise a complete set of spades and heart suits and one joker. The second set should also comprise a complete set of spades and heart suits and one joker so the second set of cards is identical to the first set of cards.

Preferably, the card game of the present invention is played on a standard nine-player card table utilized by most present day casinos and cardrooms. Nine players sit at the table and each person antes up the required ante, which can be three chips each. After shuffling the first set of cards, the dealer deals three cards, one at a time, to each player face down in front of the player from the first set of cards, thereby utilizing all 27 cards. After all the cards are dealt, each player turns over his or her three cards and places a chip on the top or "pot" side (i.e., the center of the table) of the card.

After shuffling the second set of cards, the dealer begins revealing one card at a time from the top of the second set of cards. As the match cards are revealed, the dealer announces the value of the card and the players check to see if their card matches the suit and value of the match card revealed by the dealer from the second set. If so, the player takes the chip from the top side of the card and places it on top of their matching card. The dealer keeps turning over one card at a time from the second set until one player has matched all three of his or her cards (i.e., a chip on each card in front of them). All of the matched chips, those on top of a card, stay with the player whose card matched. All of the unmatched chips go into the pot, from which the casino or cardroom takes its cut and the dealer receives his tip. The remainder of the pot is distributed to the winner, the person with three matched cards. The first set and second set are either gathered and re-shuffled or discarded and new decks obtained so the game can begin again.

By requiring a separate ante and the player to place his or her own chip on the cards in front of them, the game creates larger pots (dependant on the ante) and requires player involvement. The player feels as though he or she is more of a participant than a spectator, as can be with other matching card games. By using the standard nine-player card table and standard playing cards, casinos and cardrooms are not required to purchase new equipment or machinery in order to offer the card game according to the present invention.

Accordingly, the primary objective of the present invention is to provide a matching card game that is a new card game requiring more chance than skill or game knowledge, thereby giving each player an equal chance to win.

It is also an important objective of the present invention to provide a matching card game that is relatively easy to learn to play, yet provides player involvement.

It is also an important objective of the present invention to provide a matching card game that utilizes equipment and materials commonly utilized in casinos and cardrooms to make it relatively inexpensive for casinos and cardrooms to offer.

It is also an important objective of the present invention to provide a matching card game that utilizes two matching sets of cards having 27 cards in each set.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION

Figure 1:
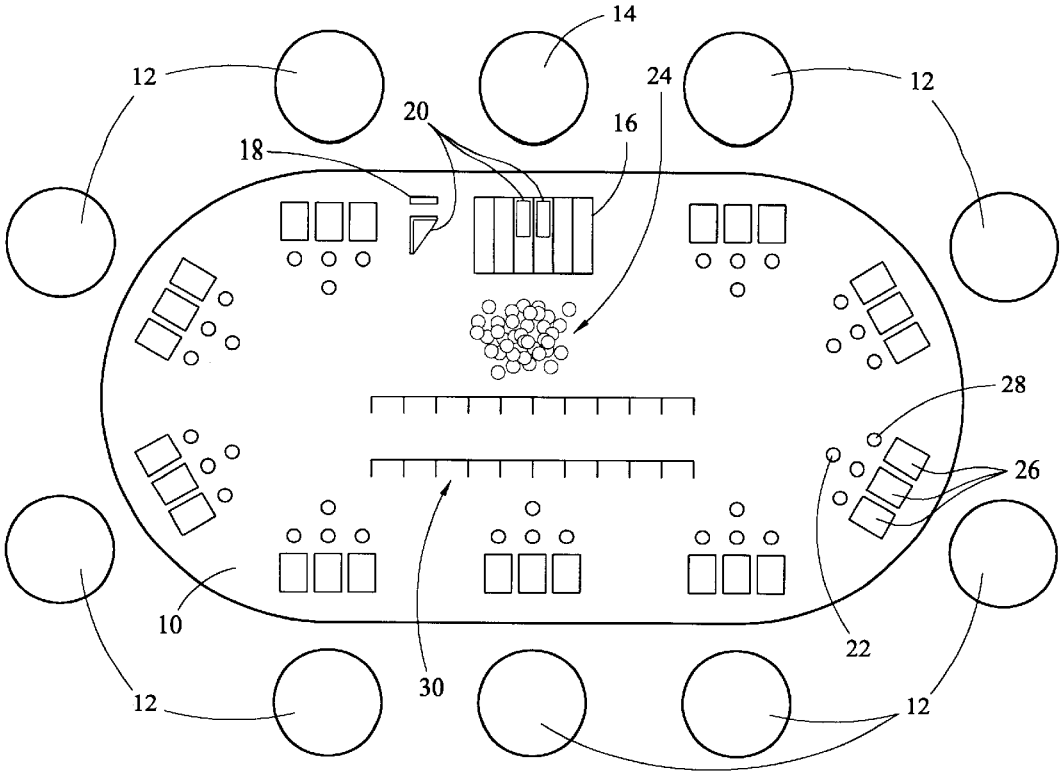
FIG. 1 is a top view of one embodiment of the game of the present invention on a standard poker table.
Figure 2:
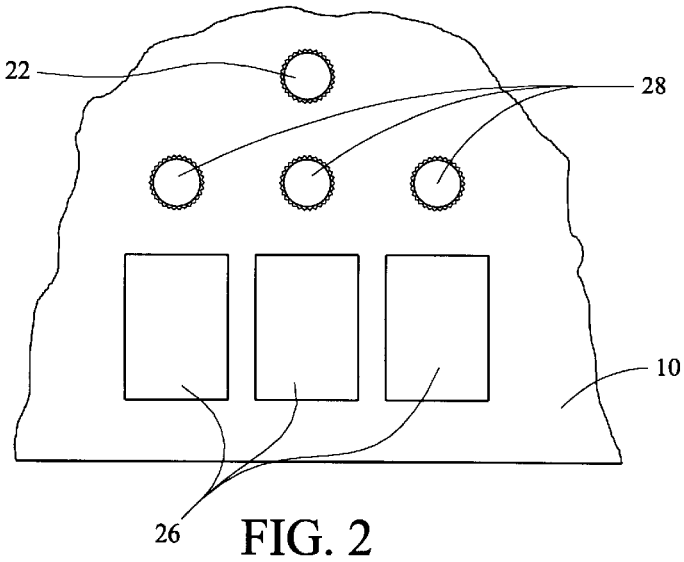
FIG. 2 is an enlarged detail view of a player's station.

With reference to FIGS. 1 and 2, where like elements have been given like numerical designations to facilitate understanding of the present invention, the preferred embodiment of the method of playing a matching card game of the present invention can be played on a table having a playing surface 10. Surface 10 is found on nine-player Texas Hold'em poker tables that are commonly utilized by most casinos and cardrooms. The present card game can be played on other playing surface, other tables and with other number of players. However, because of the prevalence of the Texas Hold'em-type poker tables, the preferred embodiment of the card game is best suited for these types of tables. These tables have nine player seats 12 and one dealer seat 14, as shown in FIG. 1. On surface 10 near dealer seat 14 is located a dealer tray 16 from which the dealer obtains cards, a drop slot 18 for house (the casino or cardroom) money and one or more discard racks 20.

To start the game, each player takes their position on one of the player seats 12 and the dealer or game facilitator takes his or her position on the dealer seat 14. The dealer obtains two matching sets of cards, a first set and a second set. In the preferred embodiment of the present card game, each set contains 27 standard playing cards (i.e., Ace, 2–10, Jack, Queen and King) made up of all 13 playing cards from one suit (i.e., spades, diamonds, clubs or hearts), all 13 playing cards from another suit and a joker. For ease in use, the suits can be one black suit (i.e., spades or clubs) and one red suit (i.e., diamonds or hearts). Whichever suits or cards are chosen for the first set, it should match that chosen for the second set. Each set is shuffled thoroughly to ensure that they are mixed in a random manner. For additional ease of playing, the backs of the cards in the first set can be of a color that contrasts with the back of the cards that make up the second set (i.e., blue for the first set and red for the second set).

Each player antes up, or posts, a predetermined amount of chips, such as one, two, three or more chips, from his or her own pile of chips and places the ante into the ante placement circle 22 (as best shown in FIG. 2) in front of his or her player chair 12. After posting of the ante, the dealer removes the ante chips and places them in or near the center of the playing surface 10 to form a pot 24 of chips, shown in FIG. 1. From pot 24, the dealer removes chips for the house cut and places them in drop slot 18. The dealer then deals the cards from the first set of cards one at a time to each player by placing a single card in front of each player face down in one of the player's card placement boxes 26 going around the table and then repeating the cycle until each player has three cards laying face down in front of him or her, one in each of placement boxes 26. Once all the cards from the first set of cards is dealt, the players turn the cards in their placement boxes 26 face up, leaving the cards in the placement boxes 26. The player then takes three chips from his or her own pile of chips and places one chip on each of the three playing chip placement circles 28 located near the top edge of each player's card placement box 26.

After the first set of cards is completely dealt to all the players, when nine players are participating this will utilize all 27 cards, the dealer begins revealing one card at a time from the second set of cards and places the card, designated the match card, into one of the match stalls 30. As a match card from the second set is revealed, the dealer announces the card's value and suit and the players compare the cards in their placement boxes 26 to the match card. If the match card matches one of the player's cards, designated the matching card, the player takes the chip from the placement circle 28 and places it on the matching card in placement box 26. The dealer continues revealing one match card at a time from the second set of cards until one of the players has a chip on all three of their cards located in the placement boxes 26 in front of their player seat 12. The first player having a chip on all three cards notifies the dealer of this fact by stating "bingo" or the like. At this time, the turning over of cards by the dealer from the second set of cards ceases.

Based on experience with the card game of the present invention, a bingo typically occurs within an average of approximately 14 cards revealed from the second set.

The dealer verifies that the player in fact has a match card in one of the match stalls 30 for each card in the player's placement boxes 26. If not, the dealer continues revealing cards from the second set of cards. If the player does match each of their cards, the dealer collects all the unmatched chips, those still remaining in the placement circles 28 and places those chips in pot 24. The chips located on top of a card in a placement box 26 are removed and kept by the player who put it there. The amount in pot 24 is given to the player who first had a match for each of his or her cards as the winnings, from which the player can tip the dealer if desired. The first and second set of cards are either disposed in the discard rack 20, as is typical, or shuffled for reuse. A new round of the card game then begins.

Although the game of the present invention is similar to bingo in nature, as far as skill and knowledge required, it is also similar to poker in that it has a similar pari-mutual payoff. From the above description, it is clear that the sooner in the dealing process in which a player matches all three of his or her cards, the larger pot 24 will be due to the greater number of chips still in placement circles 28. The size of pot 24 for winnings and house payments can be easily adjusted by varying the amount of ante each player is required to place on ante placement circle 22 prior to the game starting.

A number of variations in equipment and materials are possible to use for the present invention. For instance, instead of being played on a Texas Hold'em poker table, the game surface 10 can be a felt material that is marked in accordance with the description above or in accordance how the game is desired to be played. Instead of playing cards, any type of cards can be used that provide two matching sets having 27 different cards in each set. For instance, cards can be utilized that are numbered consecutively from 1 to 27 or any other like group of numbering. In addition, any other type of cards can be utilized. Even if cards other than standard playing cards are utilized, the cards should include a joker, or like card, that can be utilized for jackpot or bonus awards, as discussed below.

A number of variations of the above description of the game play can also be utilized. For instance, if there is less than nine players playing, one of the players can play more than one hand by playing the cards in front him or her and those in front of the player's seat 12 next to him or her. Alternatively, if there is less than nine players, the dealer can deal to those players who are playing and play the game as described above. The result will be that there will be some cards turned over from the second set of cards that do not have a match for one of the cards located in the placement boxes 26. No player would be able to place a chip down and the dealer would continue revealing cards from the second set.

Another variation that adds some level of skill and judgment to the game is to allow players the option of folding their hands before a bingo is announced. A player who wishes to fold can turn his or her cards face down in front of them and place one chip on top of the pile of cards. This one chip will be retained by the player. The other two chips and the original ante will be forfeited to the pot to be divided among the winner and the house/dealer. Other variations on this are also possible.

For additional excitement and increased winnings, the casino or cardroom can provide bonuses or jackpots upon the occurrence of certain events. In the preferred embodiment, for instance, the player who matches all three of his or her cards first when one of the matching cards is the joker can receive a bonus or jackpot payment from the house. Likewise, a person who gets a bingo in the first three match cards from the second set of cards can receive a bonus or jackpot reward for the occurrence of this relatively rare event.

Another variation to the game of the present invention is to utilize a the dealer button used in poker and poker-type games. As used in those games, the dealer button designates the person who would be sitting in the position of the dealer if the cards were passed around the table for dealing. Generally, the person to the left of the player who has the dealer button is dealt first and plays first. For the game of the present invention, the dealer button can be used to as a means of designating a person who gets a bonus or jackpot. One such way of utilizing the dealer button is to award a bonus or jackpot to the player who has the dealer button if he or she is also the first person to match all three of his or her cards, thereby winning the round.

While there is shown and described herein certain specific alternative forms of the invention, it will be readily apparent to those skilled in the art that the invention is not so limited, but is susceptible to various modifications and rearrangements in design and materials without departing from the spirit and scope of the invention.

What is claimed is:

1. A method of playing a matching card game, comprising the steps of:

posting an ante by each participating player to form a pot;

providing a first set of cards, said first set of cards mixed in a random manner;

providing a second set of cards, said second set of cards mixed in a random manner, said second set of cards being identical to said first set of cards;

dealing each of said participating players a predetermined number of cards from said first set of cards, said predetermined number of cards forming a row of cards for each of said participating players;

placing a chip near each of said cards in said row of cards;

after placing a chip near each of said cards, revealing a match card from said second set of cards;

comparing each of said cards in said row of cards with said match card to identify a matching card in said row of cards;

after identifying a matching card, placing said chip located near said matching card on said matching card; and revealing another of said match card from said second set of cards and comparing said cards in said row of cards with said match card until one of said participating players has each of said cards in said row of cards with said chips on each of said cards, said one of said participating players being designated a winner.

2. The method of playing a matching card game of claim 1, wherein said first set of cards has 27 cards, said second set of cards has 27 cards and said predetermined amount of cards is three.

3. The method of playing a matching card game of claim 1, wherein said card game is played in combination with a nine-player poker table.

4. The method of playing a matching card game of claim 1, wherein each of said first set of cards and said second set of cards has one joker.

5. The method of playing a matching card game of claim 4, wherein said joker designates a jackpot for said winner if said joker is in said winner's said row of cards.

6. The method of playing a matching card game of claim 1 further comprising a dealer button, said dealer button designating a jackpot for said winner if said winner has said dealer button.

7. The method of playing a matching card game of claim 1, wherein said placing steps are performed by each of participating players.

8. The method of playing a matching card game of claim 1 further comprising the step of announcing the value of each of said match cards when revealing said match cards from said second set of cards.

9. The method of playing a matching card game of claim 1, wherein said dealing step comprises dealing said predetermined number of cards face down to each of said participating players, claim 1 further comprising the step of turning over each of said cards in said row of cards so said cards are laying face up after said dealing step.

10. The method of playing a matching card game of claim 1 further comprising the step of deciding whether to fold said row of cards.

11. The method of playing a matching card game of claim 1 further comprising the step of verifying said matching cards of said winner.

12. A method of playing a matching card game, comprising the steps of:

posting an ante by each participating player to form a pot;

providing a first set of cards, said first set of cards mixed in a random manner;

providing a second set of cards, said second set of cards mixed in a random manner, said second set of cards being identical to said first set of cards;

dealing each of said participating players a predetermined number of cards from said first set of cards, said predetermined number of cards forming a row of cards for each of said participating players;

placing a chip near each of said cards in said row of cards;

after placing a chip near each of said cards, revealing a match card from said second set of cards;

announcing the value of each of said match cards when revealing said match cards from said second set of cards;

comparing each of said cards in said row of cards with said match card to identify a matching card in said row of cards;

after identifying a matching card, placing said chip located near said matching card on said matching card;

revealing another of said match card from said second set of cards and comparing said cards in said row of cards with said match card until one of said participating players has each of said cards in said row of cards with said chips on each of said cards, said participating player being designated a winner; and giving said pot to said winner.

13. The method of playing a matching card game of claim 12, wherein said first set of cards has 27 cards, said second set of cards has 27 cards and said predetermined amount of cards is three.

14. The method of playing a matching card game of claim 12, wherein each of said first set of cards and said second set of cards has one joker.

15. The method of playing a matching card game of claim 14, wherein said joker designates a jackpot for said winner if said joker is in said winner's said row of cards.

16. The method of playing a matching card game of claim 12 further comprising a dealer button, said dealer button designating a jackpot for said winner if said winner has said dealer button.

17. The method of playing a matching card game of claim 12, wherein said dealing step comprises dealing said predetermined number of cards face down to each of said participating players, claim 12 further comprising the step of turning over each of said cards in said row of cards so said cards are laying face up after said dealing step.

18. The method of playing a matching card game of claim 12, wherein said placing steps are performed by each of participating players.

19. The method of playing a matching card game of claim 12 further comprising the step of deciding whether to fold said row of cards.

20. The method of playing a matching card game of claim 12 further comprising the step of verifying said matching cards of said winner.

21. A method of playing a matching card game, comprising the steps of:

posting an ante by each participating player to form a pot;

providing a first set of cards, said first set of cards comprising 27 cards mixed in a random manner;

providing a second set of cards, said second set of cards comprising 27 cards mixed in a random manner, said second set of cards being identical to said first set of cards;

dealing each of said participating players three cards from said first set of cards, said three cards forming a row of cards for each of said participating players;

placing a chip near each of said cards in said row of cards;

after placing a chip near each of said cards, revealing a match card from said second set of cards;

comparing each of said cards in said row of cards with said match card to identify a matching card in said row of cards;

after identifying a matching card, placing said chip located near said matching card on said matching card;

revealing another of said match card from said second set of cards and comparing said cards in said row of cards with said match card until one of said participating players has each of said cards in said row of cards with said chips on each of said cards, said participating player being designated a winner; and giving said pot to said winner.

22. The method of playing a matching card game of claim 21 further comprising the step of announcing the value of each of said match cards when drawing said match cards from said second set of cards.

23. The method of playing a matching card game of claim 21, wherein said dealing step comprises dealing said predetermined number of cards face down to each of said participating players, claim 21 further comprising the step of turning over each of said cards in said row of cards so said cards are laying face up after said dealing step.

24. The method of playing a matching card game of claim 21, wherein said placing steps are performed by each of participating players.

25. The method of playing a matching card game of claim 21 further comprising the step of deciding whether to fold said row of cards.

26. The method of playing a matching card game of claim 21, wherein each of said first set of cards and said second set of cards has one joker.

27. The method of playing a matching card game of claim 26, wherein said joker designates a jackpot for said winner if said joker is in said winner's said row of cards.

28. The method of playing a matching card game of claim 21 further comprising a dealer button, said dealer button designating a jackpot for said winner if said winner has said dealer button.

29. The method of playing a matching card game of claim 21 further comprising the step of verifying said matching cards of said winner.

* * * * *